United States Patent [19]

Detlefs

[11] 4,186,954

[45] Feb. 5, 1980

[54] LOCK STRIKE PLATE ASSEMBLY

[76] Inventor: Harry Detlefs, 3701 Clairmont Rd., Atlanta, Ga. 30341

[21] Appl. No.: 833,136

[22] Filed: Sep. 14, 1977

[51] Int. Cl.[2] ..... E05C 13/00

[52] U.S. Cl. ..... 292/340; 292/DIG. 53

[58] Field of Search ..... 292/340, 346, DIG. 53, 292/DIG. 54, 341.18, 341

[56] References Cited

U.S. PATENT DOCUMENTS

| | | | |
|---|---|---|---|
| 2,272,241 | 2/1942 | Fendring | 292/340 |
| 2,470,735 | 5/1949 | Young | 292/340 |
| 4,005,890 | 2/1977 | Murch | 292/346 |

FOREIGN PATENT DOCUMENTS

| | | | |
|---|---|---|---|
| 1424827 | 2/1976 | United Kingdom | 292/346 |

*Primary Examiner*—Richard E. Moore

*Attorney, Agent, or Firm*—Jones, Thomas & Askew

[57] ABSTRACT

A lock strike plate assembly includes a lock bolt housing for insertion into a recess of a door jamb and a brace member extending from the back of the housing internally into the adjoining wall support, thereby giving horizontal and vertical support to the lock strike plate, the lock bolt housing and its related lock mechanism.

3 Claims, 6 Drawing Figures

LOCK STRIKE PLATE ASSEMBLY

BACKGROUND

A conventional door lock assembly includes a strike plate (keeper plate) which is usually recessed into the facing of the door frame and a dead bolt or handle-actuated latch carried by the door which engages the strike plate and holds the door in its closed position in the door frame. In an effort to make the door plumb, the carpenter who constructs the door assembly usually shims and builds up the facing of the door opening away from the internal wall studs of the door frame in such a manner that a gap is formed between the door frame and the supporting wall studs. As a result of this "gap", the facing and attached strike plate derive little or ineffective horizontal support from the internal wall studs. With the use of a crowbar or similar object a locked door can be broken into by forcing the strike plate in the direction of the gap, that is, away from contact with the extended bolt. The conventional prior art lock mechanisms therefore offers only small resistance to an experienced burglar.

SUMMARY OF THE INVENTION

The present invention comprises a lock strike plate assembly which includes a lock keeper plate, and, as an integrated part of this keeper plate, a lock bolt housing surrounding the bolt opening in the strike plate and an elongated brace member extending away from the lock bolt housing. The lock bolt housing is mounted in a recess in the door frame facing, and the elongated brace member extends through the gap behind the door frame facing and into the internal wall studs adjacent the door frame facing where the lock strike plate and lock bolt housing both derive horizontal support in the direction transverse to the door frame so that a force against the door is resisted, and in the direction parallel to the plane of the door so that a wedging force between the door and the strike plate assembly is resisted.

Thus, it is an object of this invention to provide a rugged strike plate assembly for a door lock which provides greater strength and horizontal support to the strike or keeper plate of a door frame assembly and thereby makes the locking mechanism more effective.

It is another object of the invention to provide a lock strike plate assembly which makes door locks more protective and durable.

Other objects, features and advantages of the invention will become more apparent upon reading the following specification, when taken in conjunction with the accompanying drawings.

DETAILED DESCRIPTION

Referring now more particularly to the drawings, in which like numerals illistrate like parts throughout the several figures, FIGS. 1–6 illustrate a preferred embodiment of the lock strike plate assembly 1 which comprises keeper plate 2 illustrated as being rectangular in shape but which can be formed in any shape that allows convenient mounting on the door jamb. The keeper plate 2 defines a lock passage hole 9 which, in the disclosed embodiment, is rectangular in shape and is positioned in the center of the keeper plate.

Figure 1:
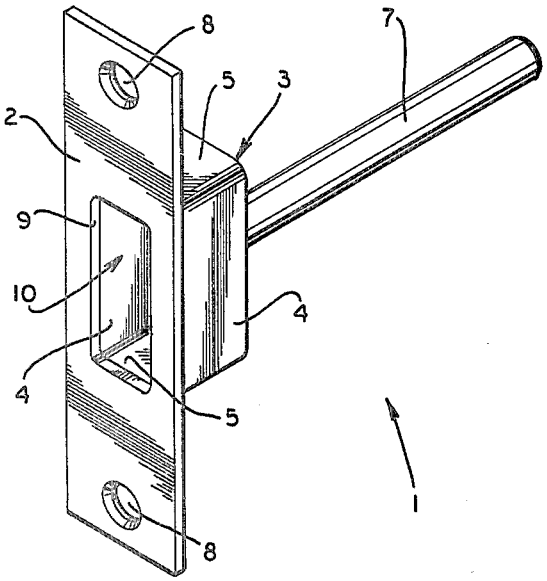
FIG. 1 is a front-side perspective view of a lock strike plate assembly according to the invention.
Figure 2:
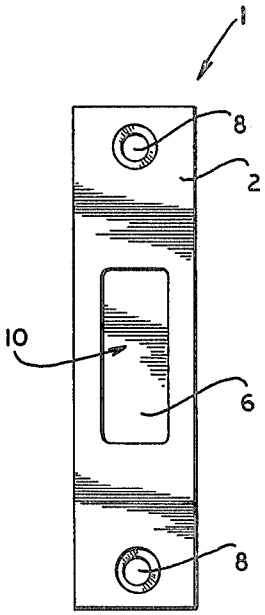
FIG. 2 is a front view of the invention of FIG. 1.
Figure 3:
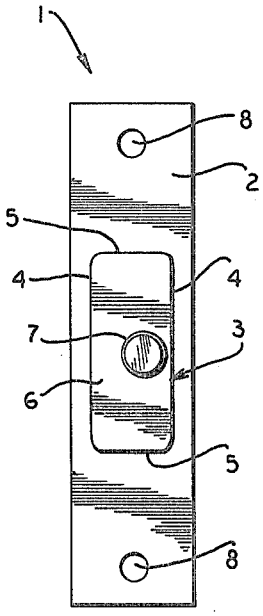
FIG. 3 is a rear view of the invention.
Figure 4:
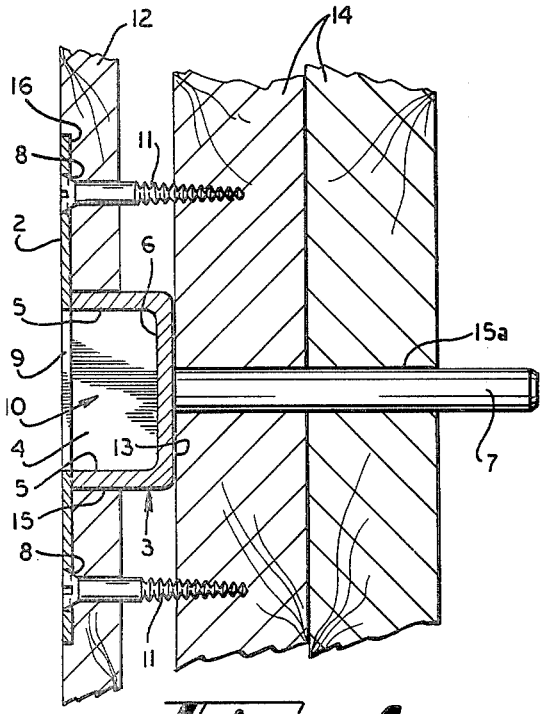
FIG. 4 is a side view of the invention in its installed position.
Figure 5:
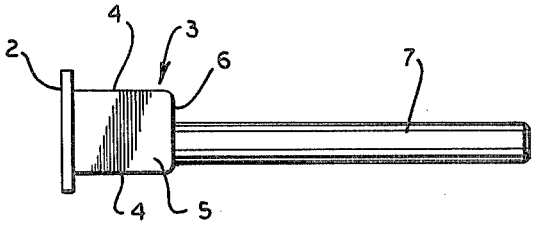
FIG. 5 is a top view of the invention.
Figure 6:
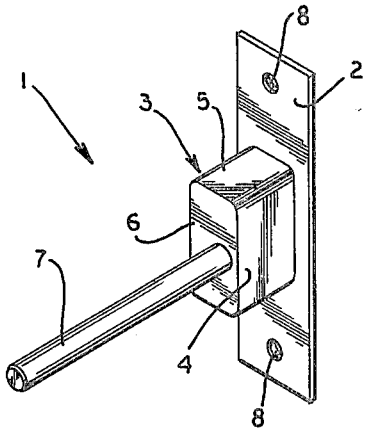
FIG. 6 is a rear-side perspective view of the invention of FIG. 1.

The lock bolt housing 3 is rigidly mounted on one side of keeper plate 2 as by welding the edge of the lock bolt housing to the keeper plate. The bolt housing 3, in this illustration, is box shaped, with parallel side walls 4, parallel top and bottom walls 5 and rear wall 6. The planes of all four walls 4, 5 are perpendicular to the plane of the keeper plate 2 as seen in FIGS. 3, 4 and 5 and the edges of the lock bolt housing are rigidly attached, as by welding, to the keeper plate 2, with the walls 4, 5 being attached to the keeper plate immediately adjacent the bolt passage 9 of the keeper plate. Of course, other embodiments of the invention are not precluded, for example a cylindrical lock bolt housing 3 may be desired depending on the shape of the bolt.

The lock bolt housing 3, being three dimensional in shape, defines a cavity 10 for receiving a protruding lock bolt. The opening of the cavity 10 is coextensive with the bolt passage hole 9 of the keeper plate 2.

Rectilinear support rod 7 is rigidly attached at one of its ends to the rear wall 6 of bolt housing 3, and extends perpendicular to said rear wall 6 and to the plane of keeper plate 2, as seen in FIGS. 3, 4, 5. The longitudinal axis of the support rod 7 is aligned with the edge of the bolt passage hole 9 of keeper plate 2. As will be understood from this description, support rod 7 functions as a brace member when the lock strike plate assembly is mounted in a door structure in the manner illustrated in FIG. 4.

As illustrated in FIG. 4, the keeper plate 2 mounts on the facing of the door jamb 12 and is fastened to the facing by screws 11 extending through screw holes 8 formed in the keeper plate 2 above and below the passage hole 9 of the assembly. The lock bolt housing 3 is inserted in a recess such as a cavity or hole 13 which is formed by the carpenter in the door jamb 12 and the brace member 7 extends through the door jamb and into the adjoining, more sturdy, wall supports 14. When the keeper plate assembly 1 is to be mounted in a door jamb structure such as is shown in FIG. 4, the carpenter drills a hole 15 through the door facing 12 and continues the hole as a cavity **15*a* into the internal wall supports studs 14. The cavity 13 in door facing 12 is chiseled out of the door facing about the bore 15, and a shallow recess 16 is formed in the facing about the cavity 13. These settings are sized and shaped to conform to the sizes and shapes of the brace member 7, lock bolt housing 3 and strike plate 2. The strike plate assembly is then inserted into the settings, by hammering if necessary, to seat the assembly tightly into the door frame structure, and screws 11 are inserted through screw holes 8 into the door jamb 12 to hold the lock strike plate assembly 1** secure in place.

It should be understood that the foregoing relates only to a preferred embodiment of the present invention, and that numerous changes and modifications can be made without departing from the spirit and the scope of the invention as defined in the following claims.

I claim:

1. A lock strike plate assembly comprising a keeper plate for attachment to the facing of a door jamb, an opening defined in a central portion of said keeper plate, a lock bolt housing rigidly mounted on said keeper plate for insertion into a recess in the facing of a door jamb, said lock bolt housing including a pair of opposed parallel side walls each connected at one edge to said keeper plate on opposite sides of the opening in said keeper plate, and a pair of opposed top and bottom walls each connected at one edge of said keeper plate on opposite sides of the opening in said keeper plate, and a rear wall opposite said keeper plate opening and connected at all four of its edges to said walls, a rectilinear support rod rigidly mounted at one of its ends directly to said rear wall and extending in a direction apoproximately perpendicular to the plane of said keeper plate for insertion into a bore extending through a door facing and into wall studs and the like adjacent the door facing, whereby the support rod derives support from the wall studs to hold the lock bolt housing in position in the door facing and the lock bolt housing derives support from the recess in the facing of the door and from the wall studs to hold the lock strike assembly in its proper position at the door jamb facing.

2. The lock strike assembly of claim 1 and wherein said side wall and said top and bottom walls of said lock bolt housing are connected to said keeper plate at the edges of the opening of said keeper plate.

3. A lock strike plate assembly comprising a keeper plate for attachment to the facing of a door jamb, an opening defined in a central portion of said keeper plate, and a lock bolt housing rigidly mounted on said keeper plate, said lock bolt housing being a rigid three dimensional frame defining a hollow cavity for insertion into a recess in the facing of a door jamb, said lock bolt housing being mounted to said keeper plate in such a manner that the opening of said cavity surrounds and includes said keeper plate opening, a rectilinear brace member rigidily mounted at one of its end directly to said lock bolt housing at a point opposite said keeper plate, said brace member extending in a direction approximately perpendicular to the plane of said keeper plate and being of sufficient length to reach into wall studs or the like adjacent to the door facing whereby the lock bolt housing is inserted into a recess in the facing of a door jamb and the brace member is inserted into the wall studs behind the facing of the door jamb and hold the lock strike plate assembly in position in a door facing.

* * * * *